US005687284A

United States Patent [19]

Serizawa et al.

[11] Patent Number: 5,687,284

[45] Date of Patent: Nov. 11, 1997

[54] EXCITATION SIGNAL ENCODING METHOD AND DEVICE CAPABLE OF ENCODING WITH HIGH QUALITY

[75] Inventors: Masahiro Serizawa; Kazunori Ozawa, both of Tokyo, Japan

[73] Assignee: NEC Corporation, Tokyo, Japan

[21] Appl. No.: 492,765

[22] Filed: Jun. 21, 1995

[30] Foreign Application Priority Data

Jun. 21, 1994 [JP] Japan ..... 6-138845

[51] Int. Cl.[6] ..... G10L 3/02

[52] U.S. Cl. ..... 395/2.31; 395/2.28; 395/2.32

[58] Field of Search ..... 395/2.31, 2.32, 395/2.28, 2.09, 2.3, 2.62

[56] References Cited

U.S. PATENT DOCUMENTS

| | | | |
|---|---|---|---|
| 5,230,036 | 7/1993 | Akamine et al. | 395/2.09 |
| 5,307,441 | 4/1994 | Tzeng | 395/2.31 |
| 5,396,576 | 3/1995 | Miki et al. | 395/2.31 |

FOREIGN PATENT DOCUMENTS

| | | | |
|---|---|---|---|
| 4-502675 | 5/1992 | Japan | G10L 9/14 |

OTHER PUBLICATIONS

Schroeder et al., "Code-excited Linear Prediction (CELP): High-quality Speech at Very Low Bit Rates", IEEE Proc. of ICASSP, 1985, pp. 937–940.

*Primary Examiner*—Allen R. MacDonald
*Assistant Examiner*—Richemond Dorvil
*Attorney, Agent, or Firm*—Foley & Lardner

[57] ABSTRACT

In an excitation signal encoding method comprising the steps of, dividing a speech signal into a plurality of frames, dividing each of the plurality of frames into a plurality of subframes each of which has a subframe length, and generating a new excitation signal by the use of an adaptive code book comprising a plurality of adaptive code vectors and a sound source code book comprising a plurality of sound source code vectors, the generating step is carried out in a predetermined period when the predetermined period is shorter than the subframe length. The generating step is carried out by the use of the adaptive code vector that is calculated using the excitation signal generated in the former period and by the use of the sound source code vector of the present period.

9 Claims, 9 Drawing Sheets

EXCITATION SIGNAL ENCODING METHOD AND DEVICE CAPABLE OF ENCODING WITH HIGH QUALITY

BACKGROUND OF THE INVENTION

This invention relates to an excitation signal encoding method and device for encoding an excitation signal with high quality at a low bit rate, such as below 4 kb/s.

For use in encoding a speech signal at a low bit rate, a code excited LPC (linear prediction coding) is already known as a CELP method. An example of the CELP method is disclosed in a paper contributed by M. R. Schroeder and B. S. Atal to the IEEE Proceedings of ICASSP, 1985, pages 937 to 940, under the title of "Code-excited Linear Prediction" (Reference 1).

According to the CELP method, a speech signal is divided into a plurality of frame signals each of which has a frame length. Each of the plurality of frame signals is further divided into a plurality of subframe signals each of which has a subframe length. LPC coefficients are calculated from each of the plurality of frame signals. An excitation signal is calculated by the use of the LPC coefficients and the subframe signals. The excitation signal is understood as a linear prediction residual component of the linear prediction coefficients. The excitation signal is encoded by pitch encoding method in which a vector quantization is carried out by the use of an adaptive code book which comprises the excitation signals decoded in the past. On the other hand, a pitch residual component of the pitch encoding is encoded in the manner of the vector quantization by the use of a sound source code book which is preliminarily made by using random numbers or the like.

In such a CELP method, there is a case that a pitch period is shorter than the subframe length as will later be described. In this case, an adaptive code vector is calculated from an approximate calculation that the excitation signal decoded in the past is repeated by the pitch period. Such an encoding method has a degraded accuracy of the pitch encoding by the pitch prediction. Incidentally, when the encoding method is carried out at the low bit rate, such as below 4 kb/s, it is required to reduce a bit number to be distributed for the excitation signal. Moreover, it is required to enlarge a vector length of the vector quantization in order to improve a quantization efficiency. For example, the vector length is 10 milliseconds long and is given by 80 samples. As a result, it is inevitable to increase the number of a pitch interval presented in a single vector. This means that the accuracy of the pitch encoding by the pitch prediction is further degraded in the case that the above-mentioned approximate calculation is used.

SUMMARY OF THE INVENTION

It is therefore an object of this invention to provide an excitation signal encoding method which can improve accuracy of pitch encoding even when a pitch period is shorter than a subframe length.

It is another object of this invention to provide the excitation signal encoding method which is of the type described with a low bit rate, such as below 4 kb/s.

It is a further object of this invention to provide an excitation signal encoding device which is suitable for the method described above.

Other object of this invention will become clear as the description proceeds.

On describing the gist of this invention, it is possible to understand that an excitation signal encoding device includes a frame division circuit for dividing a speech signal into a plurality of frames, an analyzer for carrying out a linear predictive analysis at every one of the plurality of frames to produce a parameter signal representative of spectrum parameters, a subframe division circuit for dividing each of the plurality of frames into a plurality of subframes, and a weighting circuit for calculating a weighted speech vector by the use of the spectrum parameters and the plurality of subframes.

According to an aspect of this invention, the excitation signal encoding device comprises an adaptive code book circuit storing a plurality of adaptive code vectors for selecting one of the plurality of adaptive code vectors as a selected adaptive code vector in response to an index signal. Each of the plurality of adaptive code vectors is calculated by the use of an excitation signal calculated in the past. A sound source code book circuit stores a plurality of sound source code vectors and is provided for selecting one of the plurality of sound source code vectors as a selected sound source code vector in response to the index signal. The excitation signal encoding device further comprises a calculation circuit for carrying out a predetermined calculation in a predetermined period by the use of a plurality of pitch gains, a plurality of sound source gains, the weighted speech vector, the selected adaptive code vector that is calculated by using the excitation signal generated in the former period, and the selected sound source code vector of the present period. The calculation circuit produces a calculation result as an excitation vector. A weighting synthetic circuit is supplied with the spectrum parameters and the excitation vector and carries out calculation for the excitation vector in accordance with the spectrum parameters to produce a weighted synthetic vector. A differential circuit is supplied with the weighted speech vector and the weighted synthetic vector and calculates a difference between the weighted speech vector and the weighted synthetic vector to produce a difference signal representative of the difference. An evaluation circuit is supplied with the difference signal and carries out an evaluation of the difference to supply an evaluation result, as the index signal, to the adaptive code book circuit and the sound source code book circuit. The evaluation circuit repeats the evaluation until it obtains a predetermined evaluation result. The evaluation circuit produces the index signal representative of an index of the sound source code vector and a last evaluation result on obtaining the predetermined evaluation result.

DESCRIPTION OF THE PREFERRED EMBODIMENTS

Figure 1:
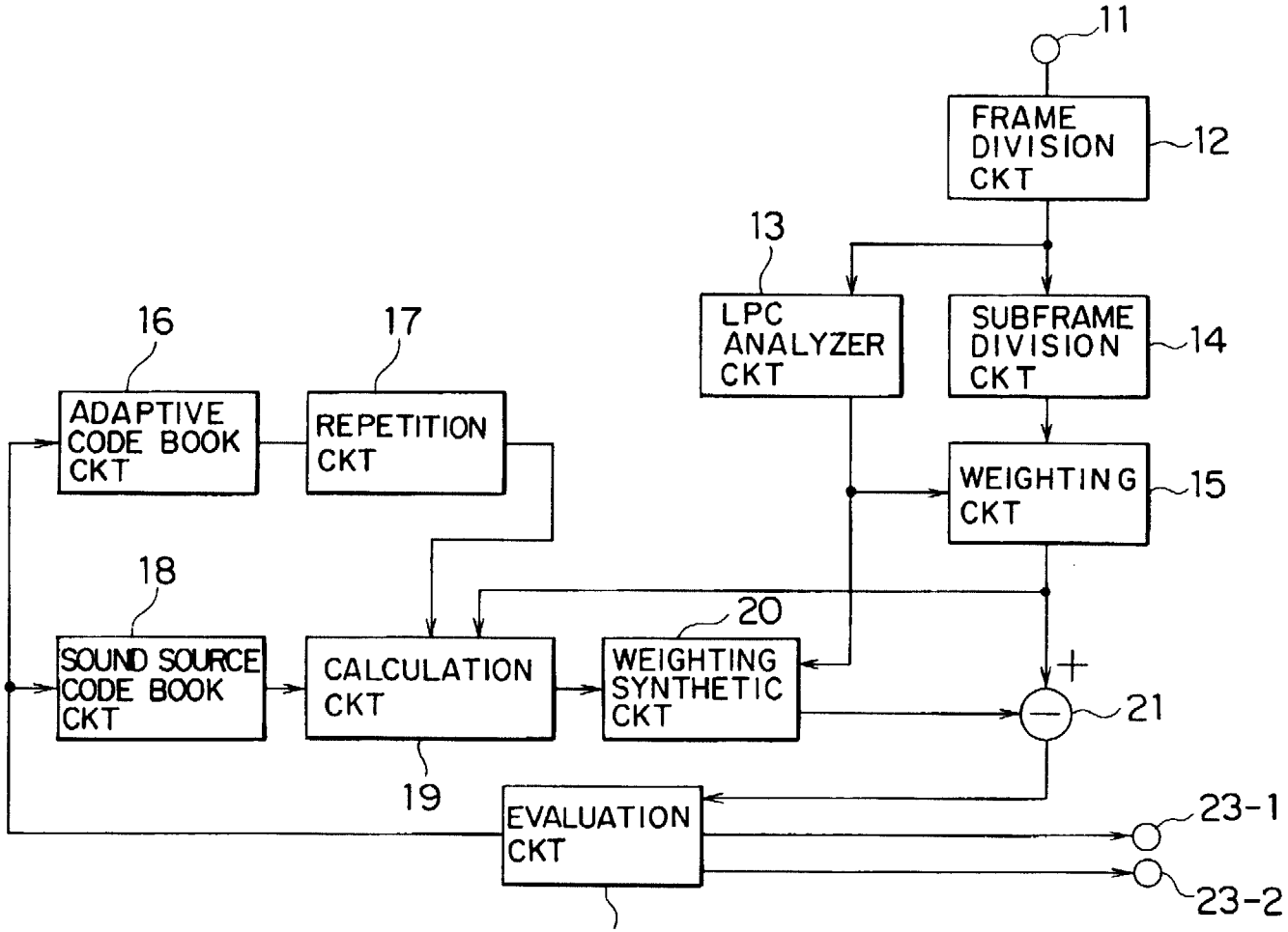
PRIOR ART FIG. 1
FIG. 1 shows a block diagram of a conventional excitation signal encoding device.

Referring to FIGS. 1 to 5, description will be made at first as regards a conventional excitation signal encoding method and a device therefor in order to facilitate an understanding of this invention. In FIG. 1, the excitation signal encoding device is for carrying out the CELP method and comprises a frame division circuit 12 supplied with a speech signal through an input terminal 11, an LPC (linear prediction coefficient) analyzer circuit 13, a subframe division circuit 14, and a weighting circuit 15.

As well known in the art, the frame division circuit 12 divides the speech signal into a plurality of frames each of which has a frame period of, for example, 20 milliseconds. The LPC analyzer circuit 13 carries out a linear predictive analyzing operation at every one of the frames and produces a parameter signal representative of an LPC coefficient $\alpha(i)$. The subframe division circuit 14 divides each of the frames into a plurality of subframes each of which has a subframe period or length of, for example, 10 milliseconds. The weighting circuit 15 calculates a weighted speech vector Ws at every one of the subframes by the use of the LPC coefficient $\alpha(i)$. The weighting circuit 15 produces a weighted speech vector signal representative of the weighted speech vector Ws.

In the speech encoding method of the CELP method, an output response H(z) of the linear prediction coding is represented by an equation (1) by the use of z transform representation.

$$H(z)=\frac{1}{1+\alpha(1)z^{-1}+\ldots+\alpha(p)z^{-p}}, \tag{1}$$

where p represents a degree of the linear prediction coding. An output response of a pitch prediction is represented by an equation given by:

$$G(z)=\frac{1}{1-\beta z^{-L}}, \tag{2}$$

where L represents a delay which is close to one or several times or one-several of a pitch period of the speech signal, and $\beta$ represents a pitch gain.

It will be assumed that a sound source signal produced from a sound source code book is represented by c(t). The sound source signal is an output signal of a filter which has the output response H(z) and which is supplied with an excitation signal y(t) given by:

$$y(t)=\beta y(t)+\gamma c(t), \tag{3}$$

where t represents time and $\gamma$ represents a sound source gain.

Generally, an adaptive code vector used in vector quantization for the pitch encoding is a partial vector cut from the excitation signal which goes back L samples to the past. The excitation signal decoded before L samples is cut into a plurality of divided excitation signals, in order to calculate a vector P(L), which has a subframe length N. In this case, the adaptive code vector a is given by:

$$a=P(L). \tag{4}$$

The excitation vector y comprising an i-th subframe is given by:

$$y=\begin{vmatrix} y(i*N+0) \\ y(i*N+1) \\ \cdot \\ \cdot \\ \cdot \\ y(i*N+N-1) \end{vmatrix}. \tag{5}$$

The sound source code vector c of an index number m is given by:

$$c=\begin{vmatrix} c(m,0) \\ c(m,1) \\ \cdot \\ \cdot \\ \cdot \\ c(m,N-1) \end{vmatrix}. \tag{6}$$

In the description hereinafter, the frame number and the index number are omitted for brevity of the description. Accordingly, the equation (3) is replaced by the following equation given by:

$$y=\beta P(L)+\gamma c. \tag{7}$$

In the quantization of the excitation vector y in the CELP method, the index indicative of the delay L and the sound source code vector are decided by the following manner. Namely, a decoded speech signal is produced by supplying the excitation vector y to the synthetic filter having the output response H(z) of the equation (1). Next, an evaluation operation is carried out by the use of a difference signal between the decoded speech signal and the input speech signal. In this event, the index of the delay L and the sound source code vector are decided in the evaluation operation so that a weighted error signal passed through a perceptual weighting filter having the following response W(Z) has a minimum square distance.

$$W(Z)=\frac{1+k\alpha(1)z^{-1}+\ldots+k^{p}\alpha(p)z^{-p}}{1+\eta\alpha(1)z^{-1}+\ldots+\eta^{p}\alpha(p)z^{-p}} \tag{8}$$

If an impulse response matrix for carrying out the synthetic operation of the equation (1) is given by H and an impulse response matrix for carrying out a perceptual weighting operation is given by W, a weighted square distance D is represented by the following equation by the use of a perceptual weighted synthetic signal vector WHy and a weighted speech vector Ws derived by the perceptual weighting filter which is supplied with the input speech vector.

$$D=(Ws-WHy)^{T}(Ws-WHy), \tag{9}$$

where T represents transposition of the vectors and the matrices. The pitch gain $\beta$ and the sound source gain $\gamma$ which minimize the weighted square distance D of the equation (9) can be obtained by satisfying the following equations given by:

$$dD/d\beta=0,\ dD/d\gamma=0.$$

In other words, an optimum pitch gain β and an optimum sound source gain γ can be calculated by the following equation given by:

$$\begin{vmatrix} \beta \\ \gamma \end{vmatrix} = \begin{vmatrix} a^T H^T W^T W H a & a^T H^T W^T W H c \\ c^T H^T W^T W H a & c^T H^T W^T W H c \end{vmatrix}^{-1} \begin{vmatrix} a^T W^T W s \\ c^T W^T W s \end{vmatrix}. \quad (10)$$

If the delay L is shorter than the vector length of the Vector quantization, the past excitation signal is not decoded yet in the present subframe. Alternatively, the vector is generated by the repetition of a part having the length equal to the pitch period of the decoded excitation signal and is used as the adaptive code vector.

Figure 2:
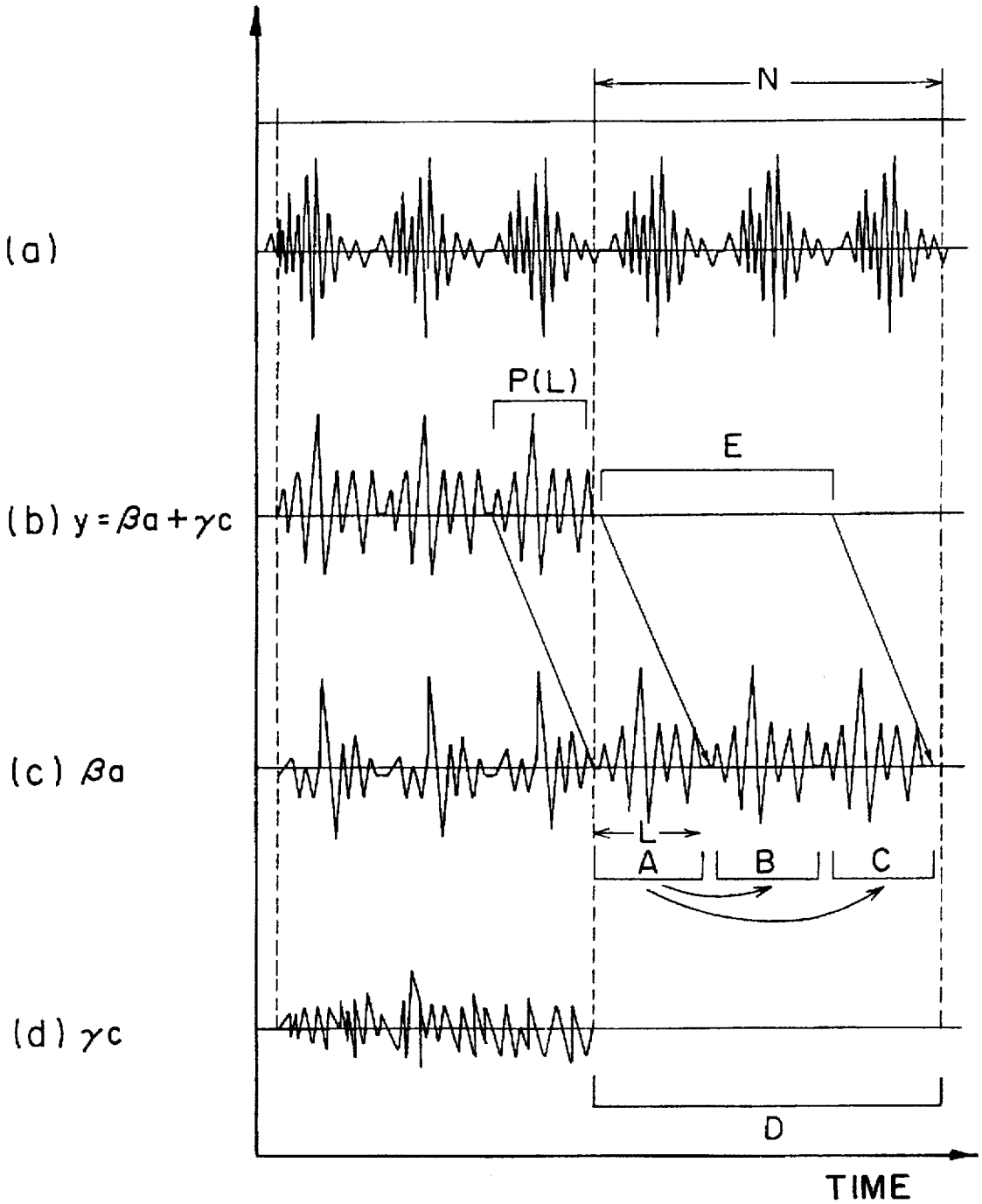
PRIOR ART FIG. 2
FIG. 2 shows signal waveforms for describing the operation of the excitation signal encoding device illustrated in FIG. 1.

Referring to FIG. 2, the description will proceed to a production process of the adaptive code vector of the present subframe in the case that the delay L is equal to one-third of the subframe length N of the speech signal (FIG. 2(*a*)). In a first pitch interval depicted at A in FIG. 2(*c*), it is possible to use the excitation signal P(L) decoded in the past. However, the excitation signal decoded before L samples (illustrated in FIG. 2*b* by E) is not present on and after a second pitch interval B. For this reason, the sound source vector of the present subframe to be quantized (illustrated in FIG. 2(*d*) by D) is approximated to all zero. Then, the adaptive code vector for the second and a third pitch intervals B and C is generated by the repetition of the first pitch interval A. As a result, the adaptive code vector is given by $$a = \begin{vmatrix} P(L) \\ P(L) \\ P(L) \end{vmatrix}. \quad (11)$$

Such an excitation signal encoding method is disclosed in Japanese Patent Publication No. 502675/1992 (Tokko Hei 4-502675) (Reference 2).

Turning back to FIG. 1, in order to carry out the above-mentioned process operation, the excitation signal encoding device further comprises an adaptive code book circuit 16, a repetition circuit 17, a sound source code book circuit 18, a calculation circuit 19, a weighting synthetic circuit 20, a differential circuit 21, and an evaluation circuit 22.

The adaptive code book circuit 16 is implemented by an RAM (random access memory) and is for storing a plurality of adaptive code vectors. As will later become clear, the adaptive code book circuit 16 is supplied from the evaluation circuit 22 with an index signal representative of the index which minimizes an error. The adaptive code book circuit 16 selects one of the plurality of adaptive code vectors as a selected adaptive code vector P(L) in accordance with the index.

Figure 3:
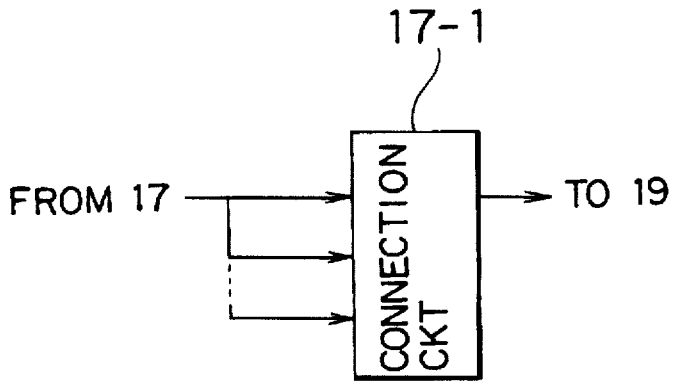
PRIOR ART FIG. 3
FIG. 3 shows a block diagram of a repetition circuit illustrated in FIG. 1.

As shown in FIG. 3, the repetition circuit 17 comprises a connection circuit 17-1 which is for carrying out calculations of the equations (4) and (11). In other words, the connection circuit 17-1 is supplied with a plurality of selected adaptive code vectors and serially connects the plurality of selected adaptive code vectors in succession. As a result, the repetition circuit 17 delivers the adaptive code vector a to the calculation circuit 19.

The sound source code book circuit 18 is implemented by an ROM (read only memory) and is for memorizing a plurality of sound source code vectors. The sound source code book circuit 18 is supplied from the evaluation circuit 22 with the index signal representative of the index which minimizes the error and selects one of the plurality of sound source code vectors as a selected sound source code vector c in accordance with the index.

Figure 4:
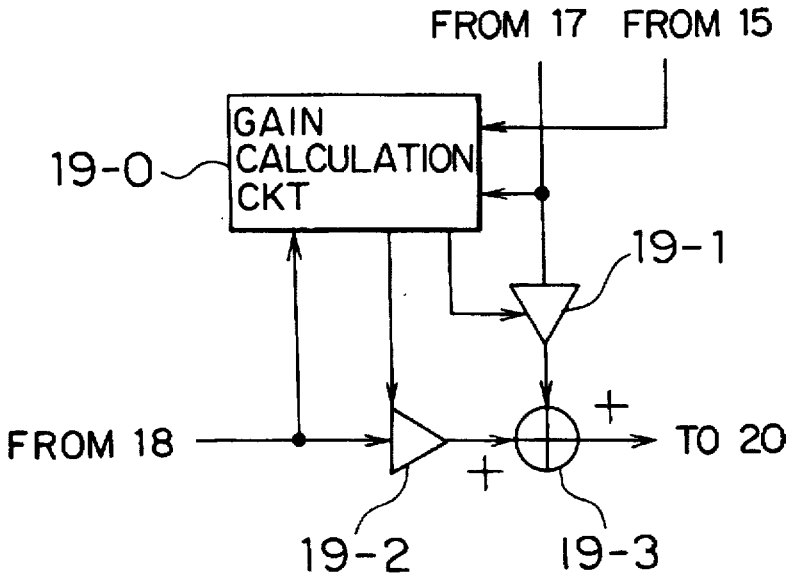
PRIOR ART FIG. 4
FIG. 4 shows a block diagram of a calculation circuit illustrated in FIG. 1.

As illustrated in FIG. 4, the calculation circuit 19 comprises a gain calculation circuit 19-0, first and second multipliers 19-1 and 19-2, and an adder circuit 19-3. The gain calculation circuit 19-0 is supplied with the adaptive code vector a, the selected sound source code vector c, and the weighted sound source vector Ws and calculates the optimum pitch gain β and the optimum sound source gain γ by the use of the equation (10). The optimum pitch gain β and the optimum sound source gain γ are supplied to the first and the second multipliers 19-1 and 19-2, respectively.

The first multiplier 19-1 multiplies the adaptive code vector a by the optimum pitch gain β and supplies a first multiplied result β a to the adder circuit 19-3. Similarly, the second multiplier 19-2 multiplies the selected sound source code vector c by the optimum sound source gain γ and supplies a second multiplied result γc to the adder circuit 19-3. The adder circuit 19-3 adds the first and the second multiplied results and produces an added result as the excitation vector y.

Turning back to FIG. 1, the weighting synthetic circuit 20 is supplied with the LPC coefficient and the excitation vector y. The weighting synthetic circuit 20 calculates a weighted synthetic vector WHy by using weighting synthetic filters each of which has the output responses W(z) and H(z) represented by the equations (1) and (8). The differential circuit 21 is supplied with the weighted synthetic vector WHy and the weighted speech vector Ws. The differential circuit 21 calculates a difference between the weighted synthetic vector WHy and the weighted speech vector Ws and delivers a difference signal representative of the difference to the evaluation circuit 22. By using the difference signal, the estimation circuit 22 calculates the weighted square distance D given by the equation (9) and supplies the index signal indicative of a next combination of the delay L and the sound source code vector to the adaptive code book circuit 16 and the sound source code book circuit 18. The evaluation circuit 22 repeats the calculation of the weighted square distance D about the delay L of a predetermined range and the plurality of sound source code vectors memorized in the sound source code book circuit 18. On completion of the above-mentioned calculation, the evaluation circuit 22 delivers the index of the delay L which minimizes the weighted square distance D to a first output terminal 23-1 and delivers the index of the sound source code vector to a second output terminal 23-2.

Figure 5:
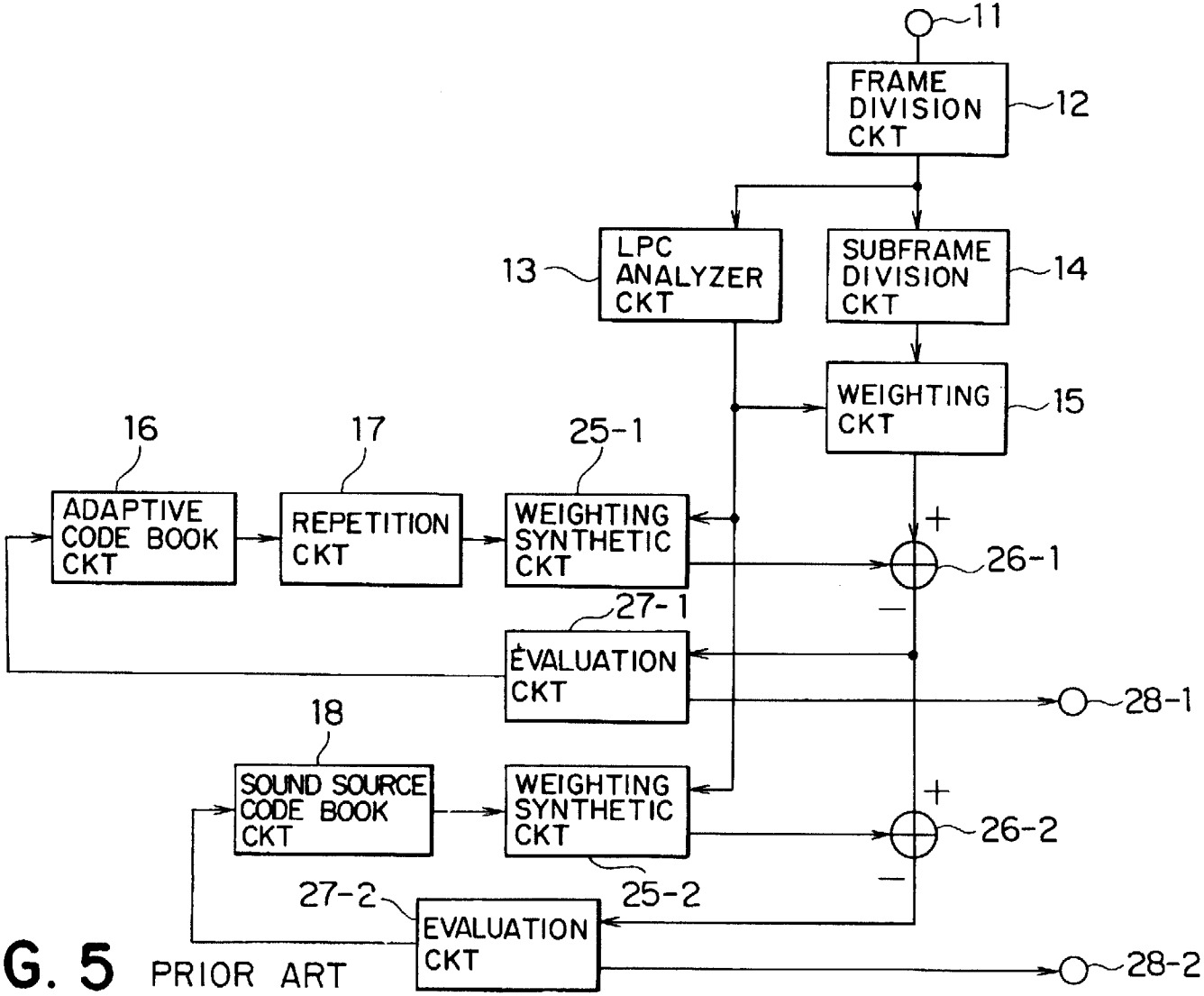
FIG. 5 PRIOR ART
FIG. 5 shows a block diagram of another conventional excitation signal encoding device.

Referring to FIG. 5, description will be made as regards another conventional excitation signal encoding device by the CELP method. The excitation signal encoding device is of the type that selects the sound source vector after a candidate of the adaptive code vector was preliminarily selected. The excitation signal encoding device comprises similar parts designated by like reference numerals except for first and second weighting synthetic circuits 25-1 and 25-2, first and second differential circuits 26-1 and 26-2, and first and second evaluation circuits 27-1 and 27-2.

As described before, the speech signal is divided by the frame division circuit 12 into a plurality of frames each of which has the frame period. The LPC analyzer circuit 13 produces the parameter signal representative of the LPC coefficient α(i). Each of the frames is divided by the subframe division circuit 14 into a plurality of subframes each of which has the subframe period. The weighting circuit 15 produces the weighted speech vector signal representative of the weighted speech vector Ws.

The adaptive code book circuit 16 is supplied from the first evaluation circuit 27-1 with the index signal representative of the index which minimizes an error. The adaptive code book circuit 16 selects one of the plurality of adaptive code vectors as the selected adaptive code vector P(L) in accordance with the index. The repetition circuit 17 carries out the calculations of the equations (4) and (11). The repetition circuit 17 delivers the adaptive code vector signal representative of the adaptive code vector a to the first weighting synthetic circuit 25-1.

The first weighting synthetic circuit 25-1 is supplied with the LPC coefficient $\alpha(i)$ and the adaptive code vector a. The first weighting synthetic circuit 25-1 calculates a weighted synthetic vector WHa by using weighting synthetic filters which have the output responses H(z) and W(z) represented by the equations (1) and (8). The first differential circuit 26-1 is supplied with the weighted synthetic vector WHa and the weighted speech vector Ws. The first differential circuit 26-1 calculates a first difference between the weighted synthetic vector WHa and the weighted speech vector Ws and delivers a first difference signal representative of the first difference to the first evaluation circuit 27-1. By using the first difference signal, the first evaluation circuit 27-1 calculates the weighted square distance D' represented by the following equation given by:

$$D'=(Ws-\beta WHa)^T(Ws-\beta WHa). \tag{12}$$

The first evaluation circuit 27-1 repeats the calculation of the weighted square distance D' about the delay L of the predetermined range. On completion of the above-mentioned calculation, the evaluation circuit 27-1 decides the index of a delay L' which minimizes the square distance D', the optimum pitch gain $\beta$, and an adaptive code vector a'. The optimum pitch gain is calculated by the equation (10) under the condition that the sound source code vector is set at zero vector, because the sound source code vector is not yet determined at this stage. The square distance D', the optimum pitch gain $\beta$, and the adaptive code vector a' are delivered through a first output terminal 28-1.

The sound source code book circuit 18 is supplied from the evaluation circuit 27-2 with the index signal representative of the index which minimizes an error. The sound source code book circuit 18 selects one of the plurality of sound source code vectors as a selected sound source code vector c in accordance with the index.

The second weighting synthetic circuit 25-2 is supplied with the LPC coefficient $\alpha(i)$ and the selected sound source code vector c. The second weighting synthetic circuit 25-2 calculates a weighted synthetic vector WHc by using weighting synthetic filters which have the output responses H(z) and W(z). The second differential circuit 26-2 is supplied with the weighted synthetic vector WHc and the first difference signal. The second differential circuit 26-2 calculates a second difference between the weighted synthetic vector WHc and the first difference and delivers a second difference signal representative of the second difference to the second evaluation circuit 27-2. By using the second difference signal, the second evaluation circuit 27-2 calculates a weighted square distance D" represented by the following equation given by:

$$D''=(Ws-\beta WHa'-\gamma WHc)^T(Ws-\beta WHa'-\gamma WHc). \tag{13}$$

The second evaluation circuit 27-2 repeats the calculation of the weighted square distance D" about the plurality of sound source code vectors memorized in the sound source code book circuit 18. On completion of the above-mentioned calculation, the second evaluation circuit 27-2 decides the index of the delay L' which minimizes the weighted square distance D", the optimum sound source gain $\gamma$, and the sound source code vector. The optimum sound source gain is calculated by the equation (10). The square distance D', the optimum sound source gain $\gamma$, and the sound source code vector are delivered through a second output terminal 28-2.

Figure 6:
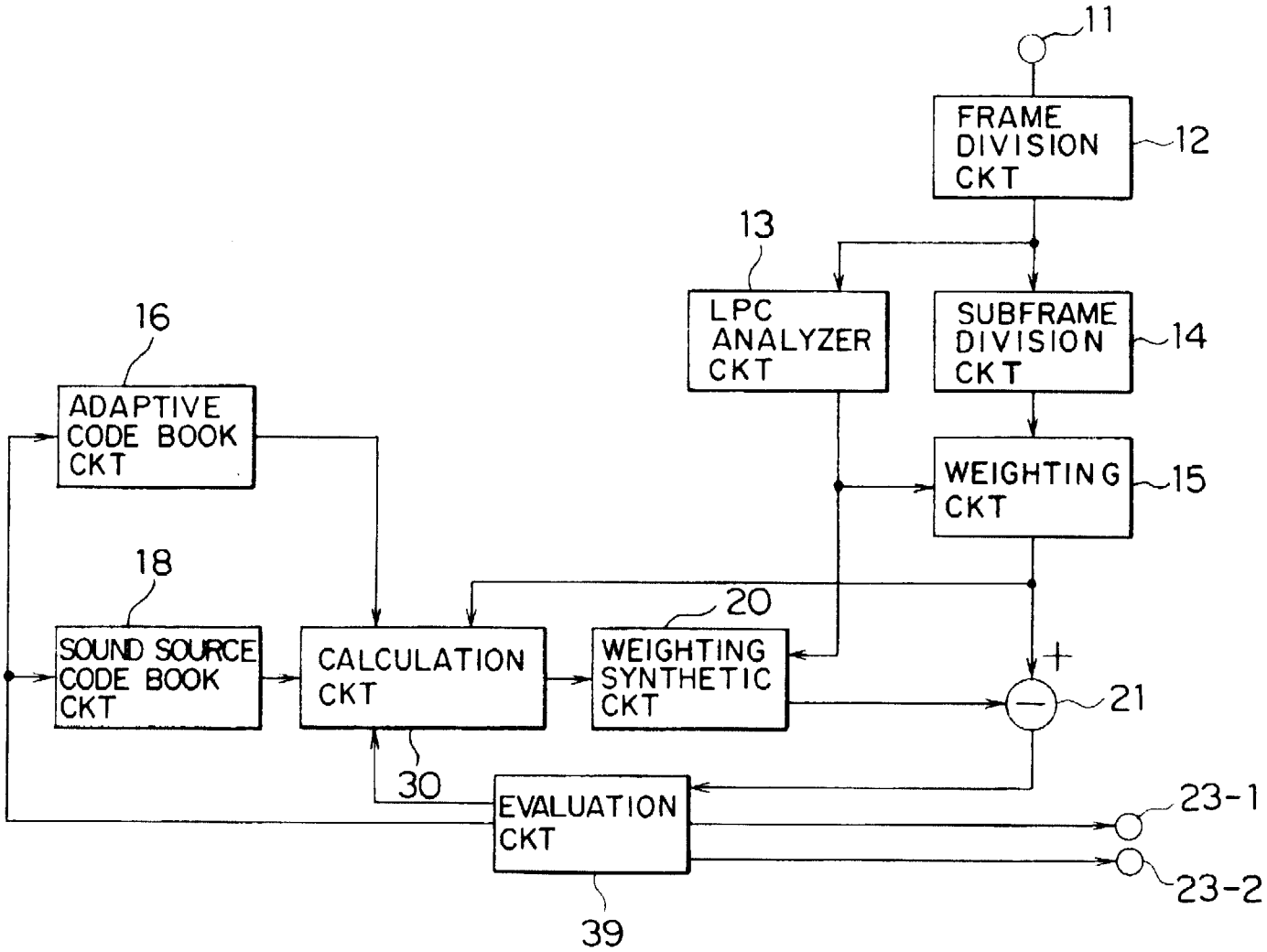
FIG. 6 shows a block diagram of an excitation signal encoding device according to a first embodiment of this invention.
Figure 7:
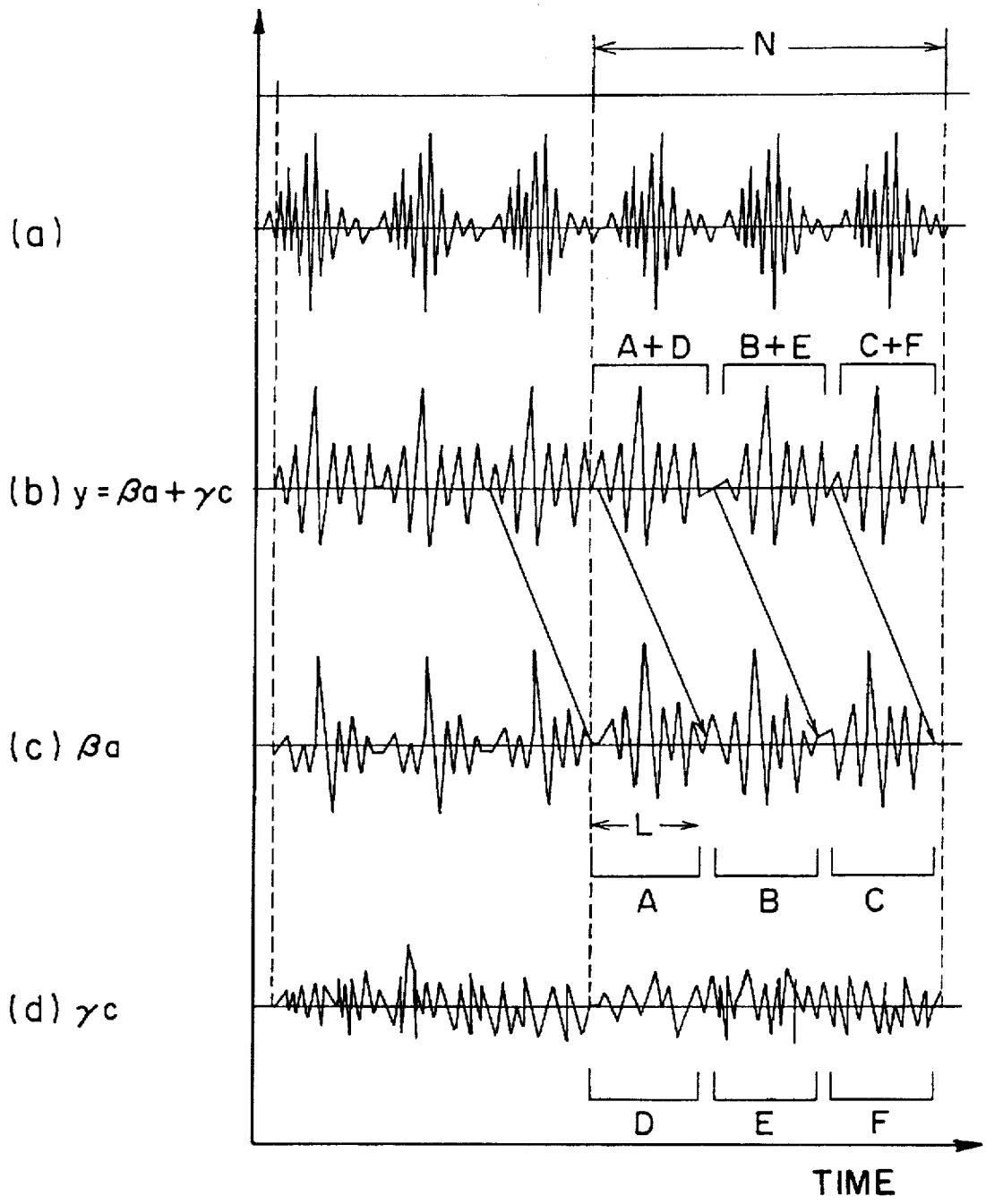
FIG. 7 shows signal waveforms for describing operation of the excitation signal encoding device illustrated in FIG. 6.
Figure 8:
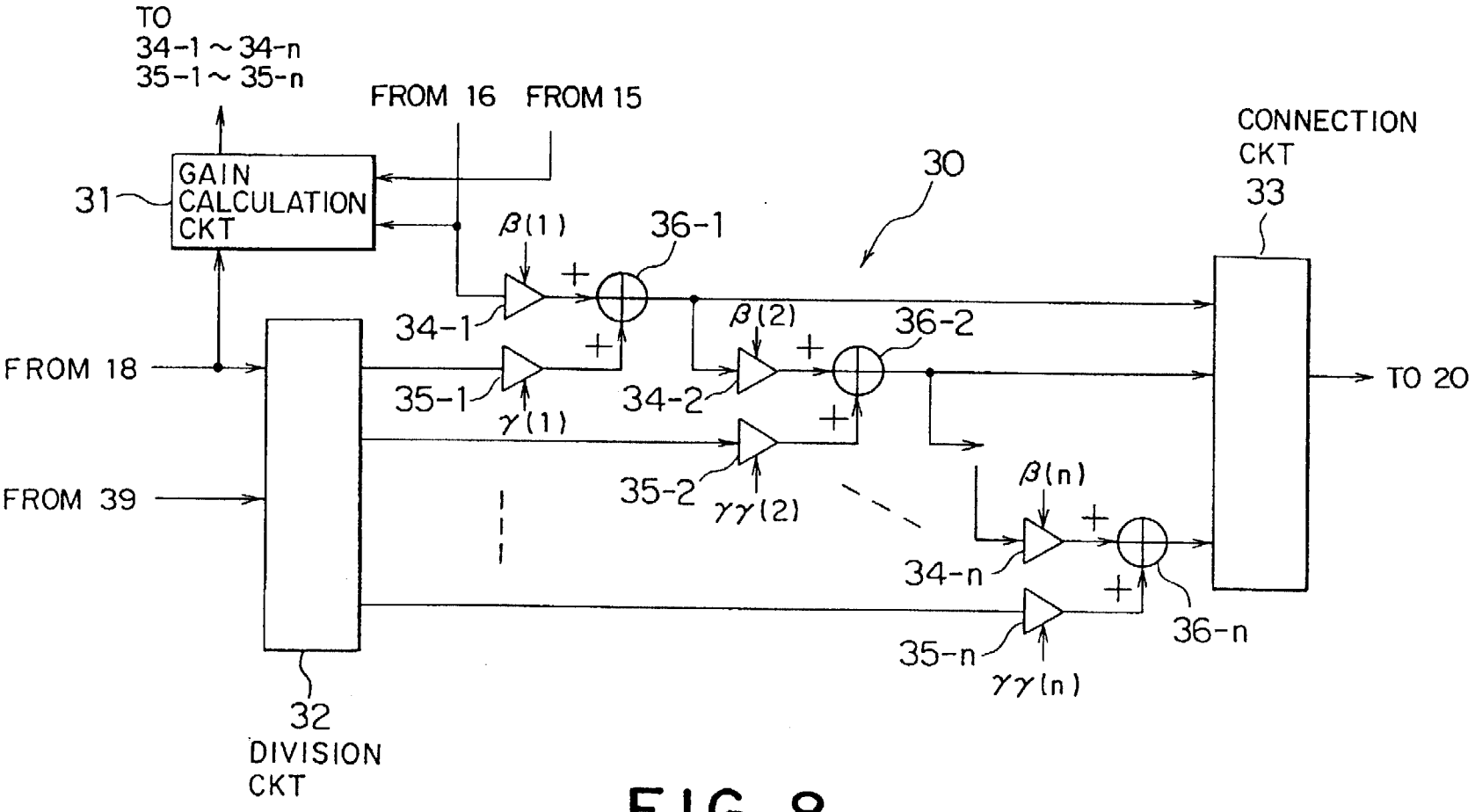
FIG. 8 shows a block diagram of a calculation circuit illustrated in FIG. 7.

Referring to FIGS. 6 to 8, the description will be made as regards an excitation signal encoding method and device according to a first embodiment of this invention. The excitation signal encoding device comprises similar parts similar to those illustrated in FIG. 1 except for a calculation circuit 30 and an evaluation circuit 39. The excitation signal encoding device is particularly suitable for the case that the delay L is shorter than the subframe length N of the subframe. The delay L may be called a predetermined period. In the following description, it will be assumed that the delay L is equal to one-third of N (L=N/3).

As illustrated in FIG. 7, each of the subframes (FIG. 7(*a*)) has the subframe length N. A first pitch period or interval A of the adaptive code vector (FIG. 7(*c*)) is calculated by the use of a part of the excitation signal (FIG. 7(*b*)) that is decoded in the previous or former pitch interval. Next, a second pitch interval B of the adaptive code vector (FIG. 7(*c*)) is calculated by the use of a part (A+D) of the excitation signal (FIG. 7(*b*)) that is decoded in the previous pitch interval. Similarly, a third pitch interval C of the adaptive code vector is calculated by the use of a part (B+E) of the excitation signal that is decoded in the previous pitch interval B. Such a process is repeated. In addition, FIG. 7(*d*) shows the sound source code vector.

Under the circumstances, the adaptive code vector a in this invention is represented by the following equation given by:

$$a=\begin{vmatrix} a(1) \\ a(2) \\ a(3) \end{vmatrix}=\begin{vmatrix} P(L) \\ \beta(2)\{\beta a(1)+\gamma c(1)\} \\ \beta(3)\{\beta a(2)+\gamma\gamma(2)c(2)\} \end{vmatrix}, \tag{14}$$

where $\beta(i)$ and $\gamma(i)$ represent the pitch gain and the sound source gain in the pitch interval i. It is supposed that the vectors c(1) and c(2) are regarded as the vector of L degrees and are defined by the following equation given by:

$$c=\begin{vmatrix} c(1) \\ c(2) \\ c(3) \end{vmatrix}. \tag{15}$$

The adaptive code vector a in this invention is represented by the equation (14) in the case of L<N. In the case of L>N, the adaptive code vector a is represented by the equation (4) for the conventional method. It is possible to improve the accuracy of the encoding in the manner that the sound source gains of the sound source code book are different in each of the pitch intervals. In this case, if each of the gains of each of the pitch intervals is given by $\gamma(i)$, the sound source code vector c' is represented by the following equation given by:

$$c'=\begin{vmatrix} c(1) \\ \gamma(2)c(2) \\ \gamma(3)c(3) \end{vmatrix}. \tag{15'}$$

Accordingly, the excitation vector y is represented by the following equation given by:

$$y = \beta a + \gamma c' \tag{16}$$

$$= \beta \begin{vmatrix} P(L) \\ \beta\beta(2)P(L) \\ \beta^2\beta(3)\beta(2)P(L) \end{vmatrix} + \gamma \begin{vmatrix} I(L) & 0(L) & 0(L) \\ \beta\beta(2)I(L) & \gamma(2)I(L) & 0(L) \\ \beta^2\beta(3)\beta(2)I(L) & \gamma(2)\beta\beta(3)I(L) & \gamma(3)I(L) \end{vmatrix} c$$

In the equation (16), I(L) represents a unit matrix of L degrees while 0(L) represents a square matrix of L degrees, which all elements are zero. Accordingly, a decoded excitation vector is determined by the delay L, the sound source code vector c, the pitch gains βand β(i), and the sound source gains γ, and γ(i).

In the first embodiment, by using the equation (14), it is possible to carry out the pitch prediction of the equation (2) without using the approximation of the equation (11) used in the conventional method even when the delay L is shorter than the subframe length L of the subframe. This means that it is possible to improve the accuracy of the pitch encoding.

The quantization of the excitation vector y in the equation (16) is carried out by searching the index of the sound source code vector c and the delay L which minimizes the weighted square distance D of the equation (9). In this event, the optimum pitch gains β and β(i) and the optimum sound source gain γ(i) can be calculated, like the equation (10), by the use of the following equation in each of the pitch intervals. In order to calculate correctly the gain, it is necessary, in the calculation of Ws, to cancel an influence signal in the past. This means that the accuracy of the pitch encoding further rises.

$$\begin{vmatrix} \beta \\ \gamma \end{vmatrix} = \begin{vmatrix} P(L)^T H^T W^T W H P(L) & P(L)^T H^T W^T W H c(1) \\ c(1)^T H^T W^T W H P(L) & c(1)^T H^T W^T W H c(1) \end{vmatrix}^{-1} \begin{vmatrix} P(L)^T W^T W s(1) \\ c(1)^T W^T W s(1) \end{vmatrix} \tag{17}$$

$$b(2) = \beta\, a(1) + \gamma\, c(1). \tag{18}$$

$$\begin{vmatrix} \beta(2) \\ \gamma(2) \end{vmatrix} = \begin{vmatrix} b(2)^T H^T W^T W H P(2) & b(2)^T H^T W^T W H c(2) \\ c(2)^T H^T W^T W H P(2) & c(2)^T H^T W^T W H c(2) \end{vmatrix}^{-1} \begin{vmatrix} b(2)^T W^T W s(2) \\ c(2)^T W^T W s(2) \end{vmatrix} \tag{19}$$

$$b(3) = \beta\, a(2) + \gamma\, \gamma(2) c(2). \tag{20}$$

$$\begin{vmatrix} \beta(3) \\ \gamma(3) \end{vmatrix} = \begin{vmatrix} b(3)^T H^T W^T W H P(3) & b(3)^T H^T W^T W H c(3) \\ c(3)^T H^T W^T W H P(3) & c(3)^T H^T W^T W H c(3) \end{vmatrix}^{-1} \begin{vmatrix} b(3)^T W^T W s(3) \\ c(3)^T W^T W s(3) \end{vmatrix} \tag{21}$$

In the above equations, each of the vectors s(1), s(2), and s(3) is regarded as the vector of L degrees and is defined by the following equation given by:

$$s = \begin{vmatrix} s(1) \\ s(2) \\ s(3) \end{vmatrix}. \tag{22}$$

Turning back to FIG. 6, the frame division circuit 12 divides the speech signal into a plurality of frames each of which has a frame period of, for example, 20 milliseconds. The LPC analyzer circuit 13 carries out a linear predictive analyzing operation at every one of the frames and produces a parameter signal representative of LPC coefficient α(i). The subframe division circuit divides each of the frames into a plurality of subframes each of which has a subframe period or length of, for example, 10 milliseconds. The weighting circuit 15 comprises a weighting filter which is defined by the output response W(z) given by the equation (8) and calculates a weighted speech vector at every one of the subframes by the use of the LPC coefficient α(i). The weighting circuit 15 produces a weighted speech vector signal representative of the weighted speech vector.

The adaptive code book circuit 16 is implemented by an RAM (random access memory) and is for storing a plurality of adaptive code vectors. As will later become clear, the adaptive code book circuit 16 is supplied from the evaluation circuit 39 with an index signal representative of index which minimizes an error. The adaptive code book circuit 16 selects one of the plurality of adaptive code vectors as a selected adaptive code vector P(L) in accordance with the index. The selected adaptive code vector P(L) is supplied to the calculation circuit 30.

The sound source code book circuit 18 is implemented by an ROM (read only memory) and is for memorizing a plurality of sound source code vectors. The sound source code book circuit 18 is supplied from the evaluation circuit 39 with an index signal representative of index which minimizes an error. The sound source code book circuit 18 selects one of the plurality of sound source code vectors as a selected sound source code vector c in accordance with the index information. The selected sound source code vector c is supplied to the calculation circuit 30.

As illustrated in FIG. 8, the calculation circuit 30 comprises a gain calculation circuit 31, a division circuit 32, a connection circuit 33, first through n-th pitch gain multipliers 34-1 to 34-n, first through n-th sound source gain multipliers 35-1 to 35-n, and first through n-th adder circuits 36-1 to 36-n. The gain calculation circuit 31 is supplied with the adaptive code vector P(L), the selected sound source code vector c, and the weighted sound source vector Ws and calculates first through n-th pitch gains β(1) to β(n) and first through n-th sound source gains γ(1) to γ(n) by the use of the equations (17) to (22). The first through the n-th pitch gains β(1) to β(n) are supplied to the first through the n-th pitch gain multipliers 34-1 to 34-n, respectively. The first through the n-th sound source gains γ(1) to γ(n) are supplied to the first through the n-th sound source gain multipliers 35-1 to 35-n, respectively.

The division circuit 32 is for dividing the sound source code vector c into first through n-th partial sound source code vectors every the delay L as shown by the equation (15). The first through the n-th partial sound source code vectors are supplied to the first through the n-th sound source gain multipliers 35-1 to 35-n, respectively. For example, the first pitch gain multiplier 34-1 multiplies the adaptive code vector P(L) by the first pitch gain β(1) into a first multiplied adaptive code vector. The first sound source gain multiplier 35-1 multiplies the first partial sound source code vector by the first sound source gain γ(1) into a first multiplied sound source code vector. The first adder circuit 36-1 adds the first multiplied adaptive code vector and the first multiplied sound source code vector into a first partial excitation vector. The second pitch gain multiplier 34-2 multiplies the first partial excitation vector by the second pitch gain $\gamma(2)$ into a second multiplied adaptive code vector. The second sound source gain multiplier 35-2 multiplies a second partial sound source code vector by the second sound source gain $\gamma(2)$ into a second multiplied sound source code vector. The second adder circuit 36-2 adds the second multiplied adaptive code vector and the second multiplied sound source code vector into a second partial excitation vector. Similarly, the n-th pitch gain multiplier 34-n multiplies an (n−1)-th partial excitation vector by the n-th pitch gain $\beta(n)$ into an n-th multiplied adaptive code vector. The n-th sound source gain multiplier 35-n multiplies the n-th partial sound source code vector by the n-th sound source gain $\gamma(n)$ into an n-th multiplied sound source code vector. The n-th adder circuit 36-n adds the n-th multiplied adaptive code vector and the n-th multiplied sound source code vector into an n-th partial excitation vector.

The connection circuit 33 connects the first through the n-th partial excitation vectors and produces the excitation vector y. In conclusion, the first through the n-th pitch gain multipliers 34-1 to 34-n, the first through the n-th sound source gain multipliers 35-1 to 35-n, the first through the n-th adder circuits 36-1 to 36-n, and the connection circuit 33 collectively serve as a calculation circuit which is for calculating the excitation vector y by the use of the equation (16). Under the circumstance, the calculation circuit 30 may be called a pitch synchronization adder circuit. The excitation vector y is supplied to the weighting synthetic circuit 20.

Turning back to FIG. 6, the weighting synthetic circuit 20 is supplied with the LPC coefficient $\alpha(i)$ and the excitation vector y. The weighting synthetic circuit 20 calculates a weighted synthetic vector WHy by using weighted synthetic filters each of which has the output responses H(z) and W(z) represented by the equations (1) and (8). The differential circuit 21 is supplied with the weighted synthetic vector WHy and the weighted speech vector Ws. The differential circuit 21 calculates a difference between the weighted synthetic vector WHy and the weighted speech vector Ws and delivers a difference signal representative of the difference to the evaluation circuit 39.

By using the difference signal, the evaluation circuit 39 calculates a weighted square distance D given by the equation (9) and supplies the index signal indicative of a next combination of the delay L and the sound source code vector to the adaptive code book circuit 16 and the sound source code book circuit 18. The evaluation circuit 39 repeats the calculation of the weighted square distance D about the delay L of a predetermined range and the plurality of sound source code vectors memorized in the sound source code book circuit 18. On completion of the above-mentioned calculations, the evaluation circuit 39 delivers the index of the delay L which minimizes the weighted square distance D to the first output terminal 23-1 and delivers the index of the sound source code vector to the second output terminal 23-2.

Figure 9:
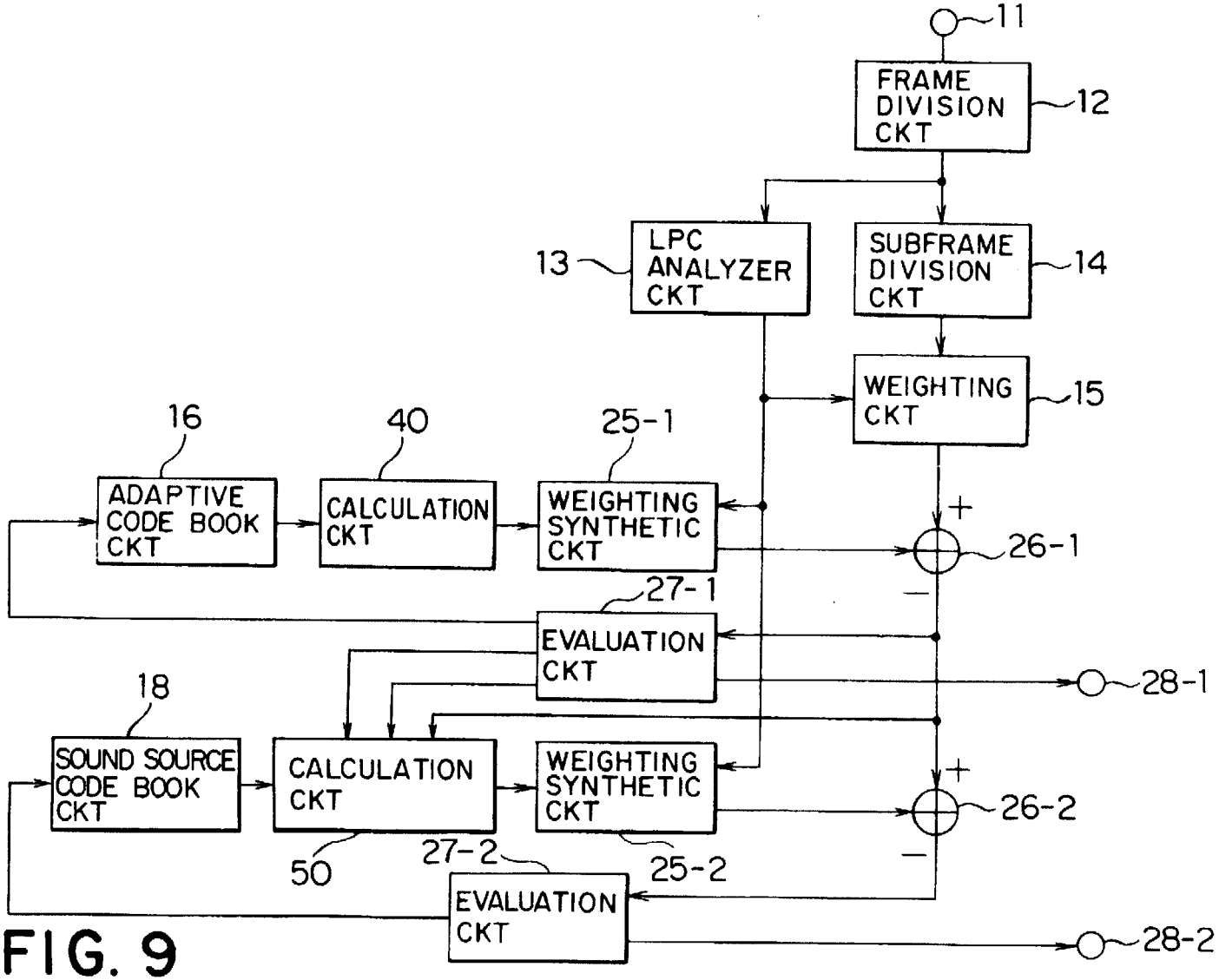
FIG. 9 shows a block diagram of an excitation signal encoding device according to a second embodiment of this invention.
Figure 10:
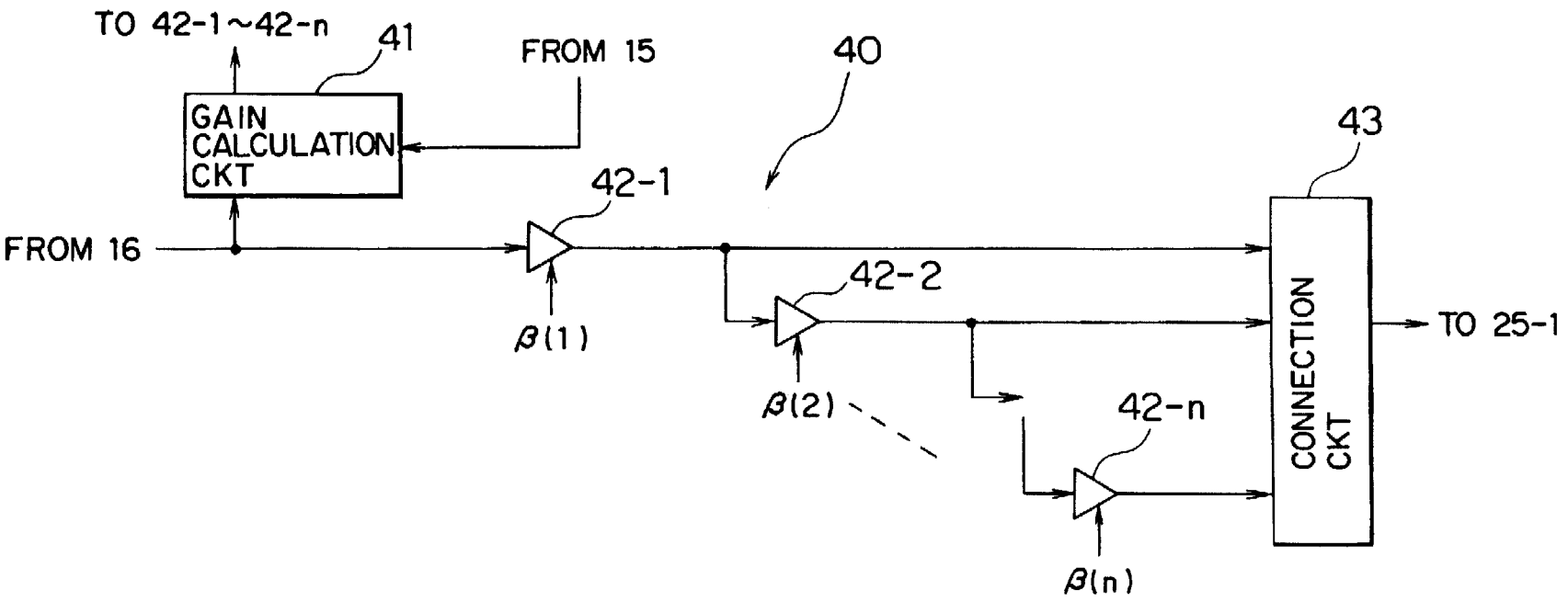
FIG. 10 shows a block diagram of a first calculation circuit illustrated in FIG. 9.

Referring to FIGS. 9 and 10, the description will proceed to an excitation signal encoding method and a device therefor according to a second embodiment of this invention. The excitation signal encoding device comprises similar parts that illustrated in FIG. 5 except for first and second calculation circuits 40 and 50. Like the first embodiment, the excitation signal encoding device is particularly suitable for the case that the delay L is shorter than the subframe length N of the subframe.

Briefly, at least one of adaptive code vectors is, at first, selected as a selected adaptive code vector. Then, an excitation vector defined by the equation (16) is synthesized by the use of the selected adaptive code vector and one of the sound source vectors preliminarily memorized in the sound source code book circuit 18. At last, the second evaluation circuit 27-2 decides, by the use of the excitation vector y, an index of the delay L and the sound source code vector which minimize the weighted square distance D defined by the equation (9). In such a second embodiment, the quantity of the calculation is extremely reduced relative to the first embodiment.

As a method for selecting a candidate of the adaptive code vector, the index of the delay L is searched by the following manner. Namely, the adaptive code vector given by the equation (14) is approximated by the equation given by:

$$a = \begin{vmatrix} a(1) \\ a(2) \\ a(3) \end{vmatrix} = \begin{vmatrix} P(L) \\ \beta(2)\{\beta a(1) + \gamma\gamma(1)c(1)\} \\ \beta(3)\{\beta a(2) + \gamma\gamma(2)c(2)\} \end{vmatrix} \sim \begin{vmatrix} P(L) \\ \beta\beta(2)a(1) \\ \beta\beta(3)a(2) \end{vmatrix}. \tag{23}$$

Then, the optimum pitch gain $\beta$ is calculated in each of the pitch intervals. The excitation vector y is obtained by the equation given by:

$$y=\beta a. \tag{24}$$

The weighted square distance D of the equation (12) is calculated. With reference to at least one of the weighted square distance D of a minimum value, the index of the delay L is searched. In addition, a plurality of values of the weighted square distance D may be selected in order of value. In this case, although the quantity of the calculation increases, it is possible to raise the accuracy of the pitch encoding.

As described in conjunction with FIG. 5, the speech signal is divided by the frame division circuit 12 into a plurality of frames each of which has the frame period. The LPC analyzer circuit 13 produces the parameter signal representative of the LPC coefficient $\alpha(i)$. Each of the frames is divided by the subframe division circuit 14 into a plurality of subframes each of which has the subframe period. The weighting circuit 15 produces the weighted speech vector signal representative of the weighted speech vector Ws.

The adaptive code book circuit 16 is supplied from the first evaluation circuit 27-1 with the index signal representative of the index which minimizes an error and selects one of the plurality of adaptive code vectors as the selected adaptive code vector P(L) in accordance with the index. The selected adaptive code vector P(L) is supplied to the first calculation circuit 40.

In FIG. 10, the first calculation circuit 40 comprises a gain calculation circuit 41, first through n-th multipliers 42-1 to 42-n, and a connection circuit 43. Supplied with the selected adaptive code vector P(L) and the weighted speech vector Ws, the gain calculation circuit 41 calculates first through n-th pitch gains $\beta(1)$ to $\beta(n)$. Such a calculation is carried out by the use of the equations (17) to (21) under the condition that the sound source code vector as regards the zero vector. The first multiplier 42-1 multiplies the selected adaptive code vector P(L) by the first pitch gain β(1) and delivers a first multiplied result to a second multiplier 42-2 and the connection circuit 43. The second multiplier 42-2 multiplies the first multiplied result by a second pitch gain β(2) and produces a second multiplied result. Similarly, the n-th multiplier 42-n multiplies an (n−1)-th multiplied result by the n-th pitch gain β(n) and delivers an n-th multiplied result to the connection circuit 43. The first through the n-th multipliers 42-1 to 42-n can be regarded as a calculator which carries out the calculation given by the equation (23). The connection circuit 43 connects the first through the n-th multiplied results and delivers an adaptive code vector a as a calculated adaptive code vector to the first weighting synthetic circuit 25-1. Taking the above into consideration, the first calculation circuit 40 may be called a gain adjustable repetition circuit.

The first weighting synthetic circuit 25-1 is supplied with the LPC coefficient α(i) and the adaptive code vector a. The first weighting synthetic circuit 25-1 calculates a weighted synthetic vector WHa by using weighting synthetic filters which have the output responses H(z) and W(z) represented by the equations (1) and (8) by the use of the LPC coefficient α(i). The first differential circuit 26-1 is supplied with the weighted synthetic vector WHa and the weighted speech vector Ws. The differential circuit 26-1 calculates a first difference between the weighted synthetic vector WHa and the weighted speech vector Ws and delivers a difference signal representative of the first difference to the first evaluation circuit 27-1. By using the first difference signal, the first evaluation circuit 27-1 calculates a weighted square distance D' represented by the following equation given by:

$$D'=(Ws-WHa)^T(Ws-WHa). \tag{25}$$

The first evaluation circuit 27-1 repeats the calculation of the weighted square distance D' about the delay L of the predetermined range. On completion of the above-mentioned calculation, the evaluation circuit 27-1 decides the index of an adaptive code vector P(L)' and the index of a delay L' which minimizes the weighted square distance D'. The index of the adaptive code vector P(L)' is delivered to the adaptive code book circuit 16 and the first output terminal 28-1. The first evaluation circuit 27-1 further delivers the delay L' and the adaptive code vector P(L)' to the second calculation circuit 50.

The sound source code book circuit 18 is supplied from the second evaluation circuit 27-2 with the index signal representative of the index which minimizes an error. The sound source code book circuit 18 selects one of the plurality of sound source code vectors as a selected sound source code vector c in accordance with the index. The second calculation circuit 50 is similar to the calculation circuit 30 (FIG. 6) except that it is supplied with the adaptive code vector P(L)' from the first evaluation circuit 27-1 in place of the adaptive code vector P(L). The second calculation circuit 50 is supplied with the adaptive code vector P(L)', the delay L', the selected sound source code vector c, and the weighted speech vector Ws and carries out the calculation similar to that described in conjunction with the calculation circuit 30 illustrated in FIG. 6. As a result, the second calculation circuit 50 delivers an excitation vector y to the second weighting synthetic circuit 25-2.

The second weighting synthetic circuit 25-2 is supplied with the LPC coefficient α(i) and the excitation vector y. The second weighting synthetic circuit 25-2 calculates a weighted synthetic vector WHy by using weighting synthetic filters which have the output responses H(z) and W(z) represented by the equations (1) and (8) by the use of the LPC coefficient α(i). The second differential circuit 26-2 is supplied with the weighted synthetic vector WHy and the weighted speech vector. The second differential circuit 26-2 calculates a second difference between the weighted synthetic vector WHy and the weighted speech vector Ws and delivers a second difference signal representative of the second difference to the second evaluation circuit 27-2. By using the second difference signal, the second evaluation circuit 27-2 calculates a weighted square distance D" represented by the following equation given by:

$$D''=(Ws-WHa'-WHc)^T(Ws-WHa'-WHc). \tag{26}$$

The second evaluation circuit 27-1 repeats the calculation of the weighted square distance D" about the plurality of sound source code vectors memorized in the sound source code book circuit 18. On completion of the above-mentioned calculation, the second evaluation circuit 27-2 decides the index of the delay L' which minimizes the weighted square distance D", the optimum sound source gain γ, and the sound source code vector. The weighted square distance D", the optimum sound source gain γ, and the sound source code vector c are delivered through the second output terminal 28-2.

While this invention has thus far been described in conjunction with a few embodiments thereof, it will readily be possible for those skilled in the art to put this invention into practice in various other manners mentioned hereinunder.

In the first and the second embodiments, as understood from the equation (3), the plurality of pitch gains can be approximated in the vector by a constant Value as given by the following equation.

$$\beta(2)=\beta(3)=1 \tag{27}$$

If the equation (27) is substituted for the equation (16), the excitation vector y given by the equation (28) can be obtained. This means that the calculation in the first and the second embodiments can be approximated by the use of the equation (28). As apparent from the equation (28), the pitch gain β, the sound source gains γ, γ(2), γ(3) are used for the calculation.

$$y=\begin{vmatrix}\beta I(L)\\ \beta^2 I(L)\\ \beta^3 I(L)\end{vmatrix}P(L)+\gamma\begin{vmatrix}I(L) & 0(L) & 0(L)\\ \beta I(L) & \gamma(2)I(L) & 0(L)\\ \beta^2 I(L) & \gamma(2)I(L) & \gamma(3)I(L)\end{vmatrix}C. \tag{28}$$

Similarly, the plurality of sound source gains can be approximated in the vector by a constant value as given by the following equation.

$$\gamma(2)=\gamma(3)=1 \tag{29}$$

If the equation (29) is substituted for the equation (16), the excitation vector y given by the equation (29) can be obtained. As a result, the calculation in the first and the second embodiments can be approximated by the use of the equation (29). As apparent from the equation (29), the sound source gain γ, the pitch gains β, β(2), β(3) are used for the calculation.

$$y=\begin{vmatrix}\beta(1)I(L)\\ \beta(2)\beta(1)I(L)\\ \beta(3)\beta(2)\beta(2)I(L)\end{vmatrix}P(L)+\gamma\begin{vmatrix}I(L) & 0(L) & 0(L)\\ \beta\beta(2)I(L) & I(L) & 0(L)\\ \beta^2\beta(3)\beta(2)I(L) & \beta\beta(3)I(L) & I(L)\end{vmatrix}C. \quad (30)$$

Furthermore, the plurality of pitch gains and the plurality of sound source gains can be approximated in the vector by a constant value as given by the following equation.

$$\beta(2)=\beta(3)=1 \quad (31)$$

$$\gamma(2)=\gamma(3)=1 \quad (32)$$

The excitation vector y is given by the following equation (33).

$$y=\begin{vmatrix}\beta I(L)\\ \beta^2 I(L)\\ \beta^3 I(L)\end{vmatrix}P(L)+\gamma\begin{vmatrix}I(L) & 0(L) & 0(L)\\ \beta I(L) & I(L) & 0(L)\\ \beta^2 I(L) & \beta I(L) & I(L)\end{vmatrix}C. \quad (33)$$

In this case, the calculation method for the pitch gains is disclosed in a paper contributed to the IEEE Transaction Vol. ASSP-34, No. 5, October, 1986.

In the second embodiment, the sound source code vector may be selected from the pitch gain $\gamma(i)$ selected by the preliminarily selection of the adaptive code book. In this case, it is possible to reduce the quantity of the calculation for the pitch gain $\beta(i)$ in the selection of the sound source code vector.

In the first and the second embodiments, the sound source code vector may be orthogonized to the adaptive code vector. As a result, it is possible to remove redundant components that included, in common, in the adaptive code vector and the sound source code vector.

In the first and the second embodiments, non integer may be used as the delay L in place of the integer in the manner which is described in Reference 1 referred before. In this case, it is possible to improve the sound quality of a female speech signal having a short pitch period.

What is claimed is:

1. An excitation signal encoding method comprising the steps of:

dividing a speech signal into a plurality of frames;

carrying out a linear predictive analysis at every one of said plurality of frames to produce spectrum parameters;

dividing each of said plurality of frames into a plurality of subframes each of which has a subframe length;

calculating a weighted speech vector by the use of said spectrum parameters and said plurality of subframes; and generating a new excitation signal by the use of an adaptive code book comprising a plurality of adaptive code vectors and a sound source code book comprising a plurality of sound source code vectors, said generating step being carried out in a predetermined period, wherein, when said predetermined period is shorter than said subframe length, the new excitation signal is generated by the use of an adaptive code vector that is calculated by using the excitation signal generated in the former period and a sound source code vector of the present period.

2. An excitation signal encoding method as claimed in claim 1, wherein said generating step comprises the steps of:

selecting at least one adaptive code vector from a plurality of calculated adaptive code vectors which are calculated by using the excitation signal generated in the former period; and generating said new excitation signal by the use of said at least one adaptive code vector and the sound source code vector of the present period.

3. An excitation signal encoding method as claimed in claim 1, wherein said generating step comprises the step of selecting the sound source code vector of the present period from a plurality of sound source code vectors.

4. An excitation signal encoding method as claimed in claim 1, wherein said generating step comprises the steps of:

calculating pitch gains and sound source gains from said weighted speech vector, said adaptive code vector that is calculated by using the excitation signal generated in the former period, and said sound source code vector from the present period;

calculating said new excitation signal based on said pitch gains and said sound source gains.

5. An excitation signal encoding method as claimed in claim 4, wherein said generating step further comprises the steps of:

producing a weighted synthetic vector from said spectrum parameters and said new excitation signal;

producing a difference signal based on a difference between the weighted speech vector and said weighted synthetic vector; and evaluating said difference signal and producing an index signal based on the evaluation result, wherein said adaptive code vector is selected from said adaptive code book based on said index signal and said sound source code vector is selected from said sound source code book based on said index signal.

6. An excitation signal encoding device including a frame division circuit for dividing a speech signal into a plurality of frames, an analyzer for carrying out a linear predictive analysis at every one of said plurality of frames to produce a parameter signal representative of spectrum parameters, a subframe division circuit for dividing each of said plurality of frames into a plurality of subframes, and a weighting circuit for calculating a weighted speech vector by the use of said spectrum parameters and said plurality of subframes, said excitation signal encoding device comprising:

an adaptive code book circuit for storing a plurality of adaptive code vectors and for selecting one of said plurality of adaptive code vectors as a selected adaptive code vector in response to an index signal, each of said plurality of adaptive code vectors being calculated by the use of an excitation signal calculated in the past;

sound source code book circuit for storing a plurality of sound source code vectors and for selecting one of said plurality of sound source code vectors as a selected sound source code vector in response to said index signal;

a calculation circuit for carrying out a predetermined calculation in a predetermined period by the use of a plurality of pitch gains, a plurality of sound source gains, said weighted speech vector, said selected adaptive code vector, and said selected sound source code vector, said calculation circuit producing a calculation result as an excitation vector;

a weighting synthetic circuit supplied with said spectrum parameters and said excitation vector for carrying out a calculation on said excitation vector in accordance with said spectrum parameters to produce a weighted synthetic vector;

a differential circuit supplied with said weighted speech vector and said weighted synthetic vector for calculating a difference between said weighted speech vector and said weighted synthetic vector to produce a difference signal representative of said difference; and an evaluation circuit supplied with said difference signal for carrying out an evaluation of said difference to supply an evaluation result, as said index signal, to said adaptive code book circuit and said sound source code book circuit, said evaluation circuit repeating said evaluation until it obtains a predetermined evaluation result, said evaluation circuit producing said index signal representative of an index of said sound source code vector and a last evaluation result upon obtaining said predetermined evaluation result.

7. An excitation signal encoding device as claimed in claim 3, wherein said calculation circuit comprises:

a gain calculation circuit supplied with said weighted speech vector, said selected adaptive code vector, and said selected sound source code vector for calculating first through n-th pitch gains as said plurality of pitch gains and first through n-th sound source gains as said plurality of sound source gains;

a division circuit for dividing said sound source code vector into first through n-th partial sound source code vectors;

a partial excitation vector calculation circuit supplied with said selected adaptive code vector and said first through said n-th partial sound source code vectors for carrying out said predetermined calculation to produce first through n-th partial excitation vectors; and a connection circuit for connecting said first through said n-th partial excitation vectors in series to produce said excitation vector.

8. An excitation signal encoding device including a frame division circuit for dividing a speech signal into a plurality of frames, an analyzer for carrying out a linear predictive analysis at every one of said plurality of frames to produce a parameter signal representative of spectrum parameters, a subframe division circuit for dividing each of said plurality of frames into a plurality of subframes, and a weighting circuit for calculating a weighted speech vector by the use of said spectrum parameters and said plurality of subframes, said excitation signal encoding device comprising:

an adaptive code book circuit for storing a plurality of adaptive code vectors and for selecting one of said plurality of adaptive code vectors as a selected adaptive code vector in response to a first index signal, each of said plurality of adaptive code vectors being calculated by the use of an excitation signal calculated in the past;

a first calculation circuit supplied with said weighted speech vector and said selected adaptive code vector for carrying out a first predetermined calculation by the use of a plurality of pitch gains, said weighted speech vector, and said selected adaptive code vector, said first calculation circuit producing a first calculation result as a calculated adaptive code vector;

a first weighting synthetic circuit supplied with said spectrum parameters and said calculated adaptive code vector for carrying out a calculation for said calculated adaptive code vector in accordance with said spectrum parameters to produce a first weighted synthetic vector;

a first differential circuit supplied with said weighted speech vector and said first weighted synthetic vector for calculating a first difference between said weighted speech vector and said first weighted synthetic vector to produce a first difference signal representative of said first difference;

a first evaluation circuit supplied with said first difference signal for carrying out an evaluation of said first difference to supply a first evaluation result, as said first index signal, to said adaptive code book circuit, said first evaluation circuit repeating said evaluation until it obtains a first predetermined evaluation result, said first evaluation circuit producing said first index signal for an optimum adaptive code vector and said optimum adaptive code vector upon obtaining said first predetermined evaluation result;

a sound source code book circuit storing a plurality of sound source code vectors for selecting one of said plurality of sound source code vector as a selected sound source code vector in accordance with a second index signal;

a second calculation circuit for carrying out a second predetermined calculation by the use of a plurality of sound source gains, said weighted speech vector, said selected sound source code vector of the present period, and said optimum adaptive code vector, said second calculation circuit producing a second calculation result as an excitation vector;

a second weighting synthetic circuit supplied with said spectrum parameters and said excitation vector for carrying out a calculation for said excitation vector in accordance with said spectrum parameters to produce a second weighted synthetic vector;

a second differential circuit supplied with said weighted speech vector and said second weighted synthetic vector for calculating a second difference between said weighted speech vector and said second weighted synthetic vector to produce a second difference signal representative of said second difference; and a second evaluation circuit supplied with said second difference signal for carrying out an evaluation of said second difference to supply a second evaluation result, as said second index signal, to said sound source code book circuit, said second evaluation circuit repeating said evaluation until it obtains a second predetermined evaluation result, said second evaluation circuit producing said second index signal for an optimum sound source code vector and a last evaluation result obtained upon obtaining said second predetermined evaluation result.

9. An excitation signal encoding device as claimed in claim 8, wherein said first calculation circuit comprises:

a gain calculation circuit for calculating first through n-th pitch gains as said plurality of pitch gains by the use of said weighted speech vector and said selected adaptive code vector;

a partial adaptive code vector calculation circuit for carrying out said first predetermined calculation by the use of said selected adaptive code vector and said first through said n-th pitch gains to produce first through n-th partial adaptive code vectors; and a connection circuit supplied with said first through said n-th partial adaptive code vectors for connecting said first through said n-th partial adaptive code vectors in series to produce said calculated adaptive code vector.

* * * * *